US007789657B2

(12) United States Patent
Buezis et al.

(10) Patent No.: US 7,789,657 B2
(45) Date of Patent: Sep. 7, 2010

(54) PRESSURE REGULATOR WITH BLEED ORIFICE

(75) Inventors: James G. Buezis, Plymouth, MN (US); Donald J. Kasprzyk, Maple Grove, MN (US)

(73) Assignee: Honeywell International Inc., Morristown, NJ (US)

( * ) Notice: Subject to any disclaimer, the term of this patent is extended or adjusted under 35 U.S.C. 154(b) by 245 days.

(21) Appl. No.: 11/866,759

(22) Filed: Oct. 3, 2007

(65) Prior Publication Data

US 2009/0092936 A1 Apr. 9, 2009

(51) Int. Cl.

| | |
|---|---|
| ***F15D 1/14*** | (2006.01) |
| *F15D 1/00* | (2006.01) |
| *F23K 5/02* | (2006.01) |
| *F23K 5/04* | (2006.01) |
| *F23K 5/16* | (2006.01) |
| *G05B 19/43* | (2006.01) |
| *G05D 16/00* | (2006.01) |

(52) U.S. Cl. ..... 431/12; 431/19; 431/75; 137/505.14; 137/906; 251/39

(58) Field of Classification Search ..... 430/12, 430/19, 75; 137/505.14, 906; 251/39; *F15D 1/00, F15D 1/14; F23K 5/02, 5/14, 5/16; G05B 19/44, G05B 19/46, 11/44; G05D 16/00, 16/02, G05D 16/04, 7/00*

See application file for complete search history.

(56) References Cited

U.S. PATENT DOCUMENTS

| | | | | |
|---|---|---|---|---|
| 309,041 | A * | 12/1884 | Geissler | 431/75 |
| 1,550,445 | A * | 8/1925 | Muller | 137/102 |
| 2,228,769 | A * | 1/1941 | Klinker | 236/8 |
| 2,599,457 | A * | 6/1952 | Jones | 431/284 |
| 2,761,464 | A * | 9/1956 | Faust | 137/116.5 |
| 2,761,464 | A * | 9/1956 | Faust | 137/116.5 |
| 2,879,783 | A * | 3/1959 | Taplin | 137/116.5 |
| 3,158,320 | A * | 11/1964 | Duncan | 431/19 |
| 3,493,005 | A * | 2/1970 | Kakegawa | 137/100 |

(Continued)

FOREIGN PATENT DOCUMENTS

| | | | |
|---|---|---|---|
| EP | 76767 | A1 * | 4/1983 |

(Continued)

OTHER PUBLICATIONS

Honeywell, Inc.; VR8200; VR4200 Combination Gas Controls; Jan. 1994; Form #68-0046-4; Fig. 2-4 (p. 5), 14-15 (p. 13-14).*

(Continued)

*Primary Examiner*—Steven B McAllister
*Assistant Examiner*—Daniel E Namay
(74) *Attorney, Agent, or Firm*—Crompton Seager & Tufte LLC

(57) ABSTRACT

A pressure regulator having a housing that defines a gas inlet, a gas outlet, and a reference pressure connector. A diaphragm is provided in the housing, where the diaphragm defines, at least in part, a reference pressure chamber. In some illustrative embodiments, the reference pressure connector fluidly references the reference pressure chamber to a first pressure via a first orifice, and to a second pressure via a second bleed orifice. A gas valve incorporating a pressure regulator is also disclosed.

25 Claims, 6 Drawing Sheets

U.S. PATENT DOCUMENTS

| | | | | | |
|---|---|---|---|---|---|
| 3,662,779 | A | * | 5/1972 | Weber et al. | 137/489 |
| 3,752,175 | A | * | 8/1973 | Hamilton et al. | 137/81.1 |
| 3,774,628 | A | * | 11/1973 | Norton et al. | 137/115.15 |
| 3,926,208 | A | | 12/1975 | Hoffman et al. | |
| 4,060,370 | A | * | 11/1977 | Fleer | 431/62 |
| 4,251,025 | A | * | 2/1981 | Bonne et al. | 236/14 |
| 4,315,520 | A | | 2/1982 | Atkinson et al. | |
| 4,340,355 | A | * | 7/1982 | Nelson et al. | 431/20 |
| 4,399,798 | A | * | 8/1983 | Stoltman | 123/676 |
| 4,543,974 | A | * | 10/1985 | Dietiker et al. | 137/66 |
| 4,790,352 | A | * | 12/1988 | Dietiker et al. | 137/613 |
| 4,893,646 | A | | 1/1990 | Wimmer | |
| 5,174,326 | A | * | 12/1992 | Steinert et al. | 137/468 |
| 5,358,004 | A | | 10/1994 | Atkinson et al. | |
| 5,435,343 | A | | 7/1995 | Buezis | |
| 5,520,533 | A | * | 5/1996 | Vrolijk | 431/90 |
| 5,595,209 | A | | 1/1997 | Atkinson et al. | |
| 5,722,454 | A | * | 3/1998 | Smith et al. | 137/503 |
| 5,890,512 | A | * | 4/1999 | Gotthelf et al. | 137/484.6 |
| 5,967,099 | A | | 10/1999 | Patrick | |
| 6,089,027 | A | | 7/2000 | Wang et al. | |
| 6,105,563 | A | | 8/2000 | Patrick | |
| 6,343,476 | B1 | | 2/2002 | Wang et al. | |
| 6,360,546 | B1 | | 3/2002 | Wang et al. | |
| 6,474,076 | B2 | | 11/2002 | Wang et al. | |
| 6,620,256 | B1 | | 9/2003 | Arno et al. | |
| 6,658,827 | B2 | | 12/2003 | Brownlie | |
| 6,786,225 | B1 | * | 9/2004 | Stark et al. | 137/1 |
| 6,860,287 | B2 | | 3/2005 | Bridges, III et al. | |
| 6,874,521 | B1 | | 4/2005 | Amidzich | |
| 6,918,756 | B2 | * | 7/2005 | Fredricks et al. | 431/12 |
| 6,923,204 | B2 | * | 8/2005 | Dalton et al. | 137/489 |
| 7,137,236 | B2 | | 11/2006 | Brownlie | |
| 2006/0292505 | A1 | * | 12/2006 | Giacomelli | 431/12 |

FOREIGN PATENT DOCUMENTS

| | | | | |
|---|---|---|---|---|
| EP | 496497 | A1 | * | 7/1992 |
| GB | 2059020 | A | * | 4/1981 |
| GB | 2270363 | A | * | 3/1994 |
| JP | 01214910 | A | * | 8/1989 |
| JP | 2000234727 | A | * | 8/2000 |

OTHER PUBLICATIONS

Honeywell, VR8205; VR4205 Direct Ignition Dual Automatic Valve Combination Gas Controls, 16 pages, 1994.

* cited by examiner

PRESSURE REGULATOR WITH BLEED ORIFICE

FIELD

The present invention relates generally to pressure regulators for gas valves, and more particularly, to pressure regulators for gas valves that include a bleed orifice.

BACKGROUND

Gas valves are commonly used in conjunction with gas-fired appliances for regulating gas flow and/or gas pressure at limits established by the manufacturer or by industry standard. In many cases, such devices can include pressure regulators to, for example, establish and/or maintain a gas pressure to help prevent over-combustion or fuel-rich combustion within the appliance, and/or to prevent combustion when the supply of gas is insufficient to permit proper operation of the appliance. Examples of gas-fired appliances that may employ such gas valves can include, but are not limited to, water heaters, furnaces, fireplace inserts, gas stoves, gas clothes dryers, gas grills, or any other such device where gas control is desired. Typically, such appliances utilize fuels such as natural gas or liquid propane as the primary fuel source, although other liquid and/or gas fuel sources may be provided depending on the type of appliance to be controlled.

In a gas-fired appliance, a combustion chamber and air plenum are typically provided along with a gas valve. A burner element, fuel manifold tube, ignition source, thermocouple, and/or pilot tube can also be provided as part of the burner system. During operation, when a heat demand is present, metered fuel is typically introduced via the gas valve through the fuel manifold tube and burner element and into the combustion chamber. The fuel is ignited by a pilot flame or other ignition source, causing fuel combustion at the burner element. In some cases, air may be drawn into the air plenum, sometimes under the assistance of an air blower, causing the air to mix with the fuel to support the combustion within the combustion chamber. The products of the combusted air-fuel mixture are typically fed through a flue or heat exchanger tube in the gas-fired appliance to heat by convection and conduction.

In some cases, the gas valve may include a pressure regulator to regulate the flow of gas at a pressure. In many cases, the pressure regulator references the pressure of the combustion chamber to help maintain and/or achieve a desired combustion level in the combustion chamber. Typically, a hose can be coupled to the pressure regulator and the combustion chamber or burner box to fluidly connect the pressure regulator and the reference pressure within the combustion chamber. It has been found, however, that in some cases, the hose may become blocked by condensate build-up or other particulate matter. Also, in some cases, the hose may become kinked or otherwise obstructed. In either case, the blockage may cause the pressure in the pressure regulator to increase or decrease resulting in over-combustion or under-combustion in the combustion chamber.

In some gas-fired systems, a separate fitting including a bleed orifice may be coupled between the pressure regulator and the hose to provide a reference pressure such as atmosphere if the hose becomes blocked. This additional fitting can, however, be removed from the system or not installed properly during installation. Also, the bleed orifice in the fitting may become blocked with grease or other material during handling.

SUMMARY

The following summary is provided to facilitate an understanding of some of the innovative features unique to the present invention and is not intended to be a full description. A full appreciation of the invention can be gained by taking the entire specification, claims, drawings, and abstract as a whole.

The present invention relates generally to pressure regulators for gas valves, and more particularly, to pressure regulators for gas valves that include a bleed orifice. In one illustrative embodiment, a pressure regulator includes a housing that defines a gas inlet, a gas outlet, and a reference pressure connector. A diaphragm member may be positioned within the housing for regulating the flow of gas from the inlet to the outlet. The diaphragm member may define, at least in part, a reference pressure chamber. The reference pressure connector may include a first opening configured to be fluidly connected to a first reference pressure, a second opening fluidly connected to the reference pressure chamber, and a third opening configured to be fluidly connected to a second reference pressure. In some cases, the first reference pressure may correspond to the pressure in a burner box of a gas-fired appliance and the second reference pressure may correspond to atmosphere. The second opening may be an orifice formed by the reference pressure connector, and the third opening may be a bleed orifice. A gas valve incorporating a pressure regulator is also disclosed.

BRIEF DESCRIPTION

The invention may be more completely understood in consideration of the following detailed description of various illustrative embodiments of the invention in connection with the accompanying drawings, in which.

DETAILED DESCRIPTION

Figure 1:
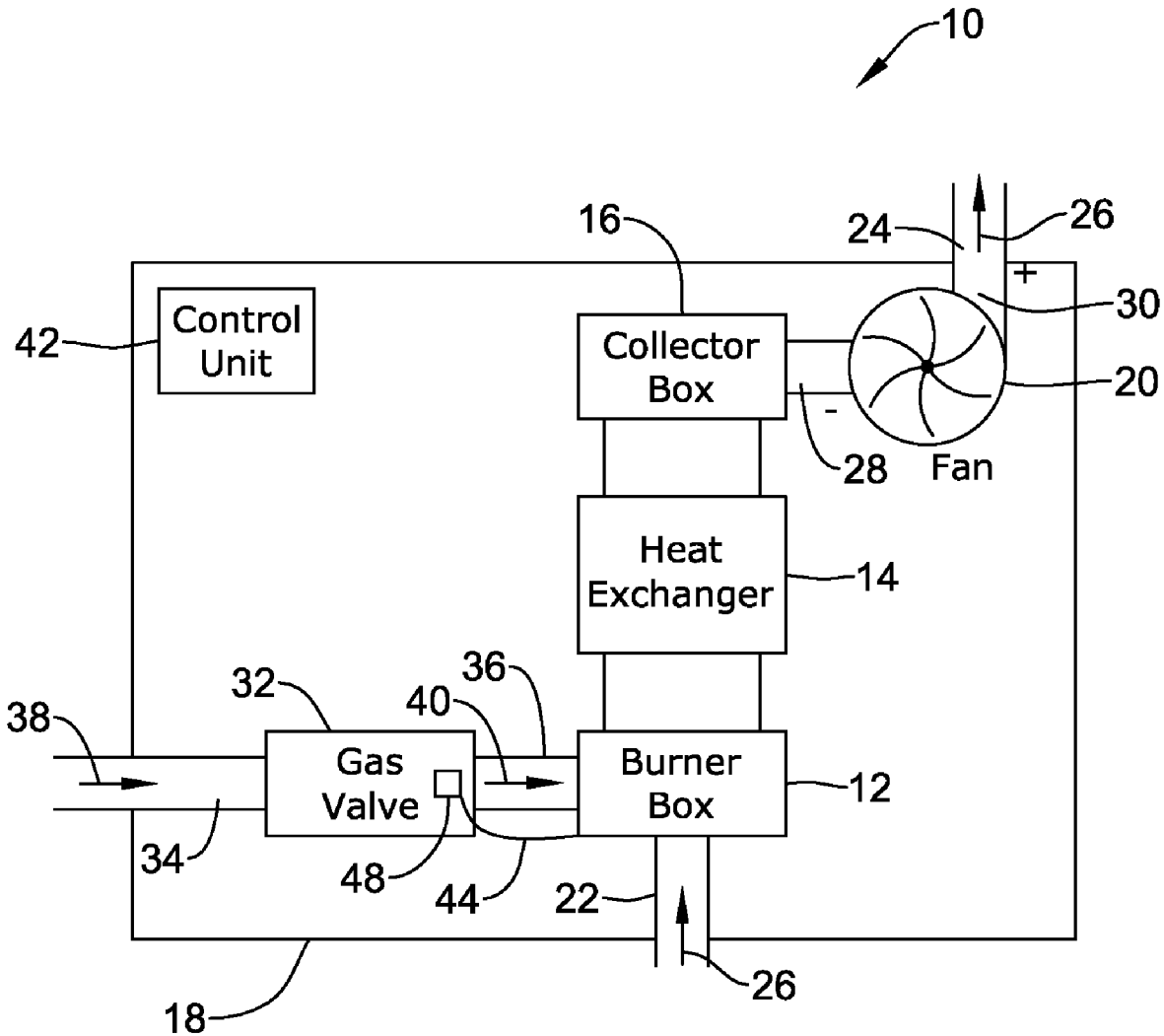
FIG. 1 is a schematic diagram of an illustrative embodiment of a gas-fired appliance.

The following description should be read with reference to the drawings wherein like reference numerals indicate like elements throughout the several views. The detailed description and drawings, which are not necessarily to scale, show several embodiments, which are meant to be illustrative of the claimed invention.

While the gas valves and systems are described with respect to gas-fired furnaces, it should be understood that the gas valves and systems described herein could be applied to the control of other gas-fired appliances, if desired. Other types of gas-fired appliances that can be controlled using the gas valves and systems described herein can include, for example, water heaters, fireplace inserts, gas stoves, gas clothes dryers, gas grills, or any other such device where gas control is desired. While the valve embodiments described are referred to as gas valves, it should be understood that the valves described herein could be used in the control of other fluids, either in liquid or gas form. Furthermore, in some embodiments, the Figures may be described with relative terms, such as "upper", "lower", "top", "bottom", "left", "right", as well as other relative terms. It is to be understood that this is merely for illustrative purposes and is not meant to be limiting in any manner.

FIG. 1 is a schematic diagram of an illustrative gas-fired appliance. The gas-fired appliance 10, illustratively a gas furnace, includes a burner box 12, a heat exchanger 14, and a collector box 16, each of which can be housed within a furnace housing 18. Sometimes, a fan 20 is provided in fluid communication with the burner box 12, heat exchanger 14, and collector box 16, and can help draw in air through an air intake 22, which can then be heated to an elevated temperature within the burner box 12. Heated air within the burner box 12 can be outputted to the heat exchanger 14 and the collector box 16, and then exhausted to a location outside of the building or structure via an exhaust flue 24. In use, the operation of the fan 20 may help produce a positive airflow in the direction indicated generally by arrow 26, forcing the heated air within the burner box 12 to be discharged through the exhaust flue 24. The use of a fan 20 is optional, as natural convection can often be used to provide the necessary draw of air into air intake. When a fan 20 is provided, and as indicated generally by the "+" and "−" signs in FIG. 1, the positive airflow 26 produces a change in pressure between the inlet side 28 and outlet side 30 of the fan 20 that can change the air/fuel combustion ratio within the burner box 12.

A gas valve 32 having a gas inlet 34 and a gas outlet 36 can be configured to regulate the supply of gas 38 that is fed to the burner box 12 for combustion. As will be discussed in greater detail below, and in some embodiments, the gas valve 32 can be configured to regulate the flow of gas 40 fed to the burner box 12 using a pressure regulator 48 as a control element. Pressure regulator 48 may include an orifice coupled to the burner box 12 via a pneumatic pressure line 44, such as a hose or other conduit. In this configuration, pressure regulator 48 may control the gas valve 32 using a reference pressure obtained from the burner box 12. In some cases, this may help decrease over-combustion and/or under-combustion in the burner box 12. In the illustrative embodiment, pressure regulator 48 may include a bleed orifice (see below) coupled to atmosphere, as will be discussed subsequently in further detail.

A control unit 42 can be provided to help control the operation of the gas valve 32 as well as to control other aspects of the gas furnace 10 including combustion within the burner box 12 and the speed and operation times of the fan 20 (when provided). The control unit 42 can further include additional functionality for controlling the pilot flame, sensing the presence of a flame at the burner 12, sensing the temperature and/or pressure within the burner box 12, shutting-off the gas supply 38 to the gas valve 32, and so forth, if desired.

During operation, the flow of gas 40 output by the gas valve 32 can be controlled, at least in part, by referencing the reference pressure provided by pneumatic pressure line 44, which in the illustrative embodiment, may sense the air pressure in the burner box 12. In some embodiments, the speed of fan 20 can be either increased or decreased, as necessary, to change the air pressure of intake air fed to the burner box 12 in order to maintain a desired heat output by the appliance. In other embodiments, the amount of gas provided by gas valve 32 may be modulated, depending on the pressure in the burner box 12, to help decrease over-combustion and/or under-combustion in the burner box 12.

Figure 2:
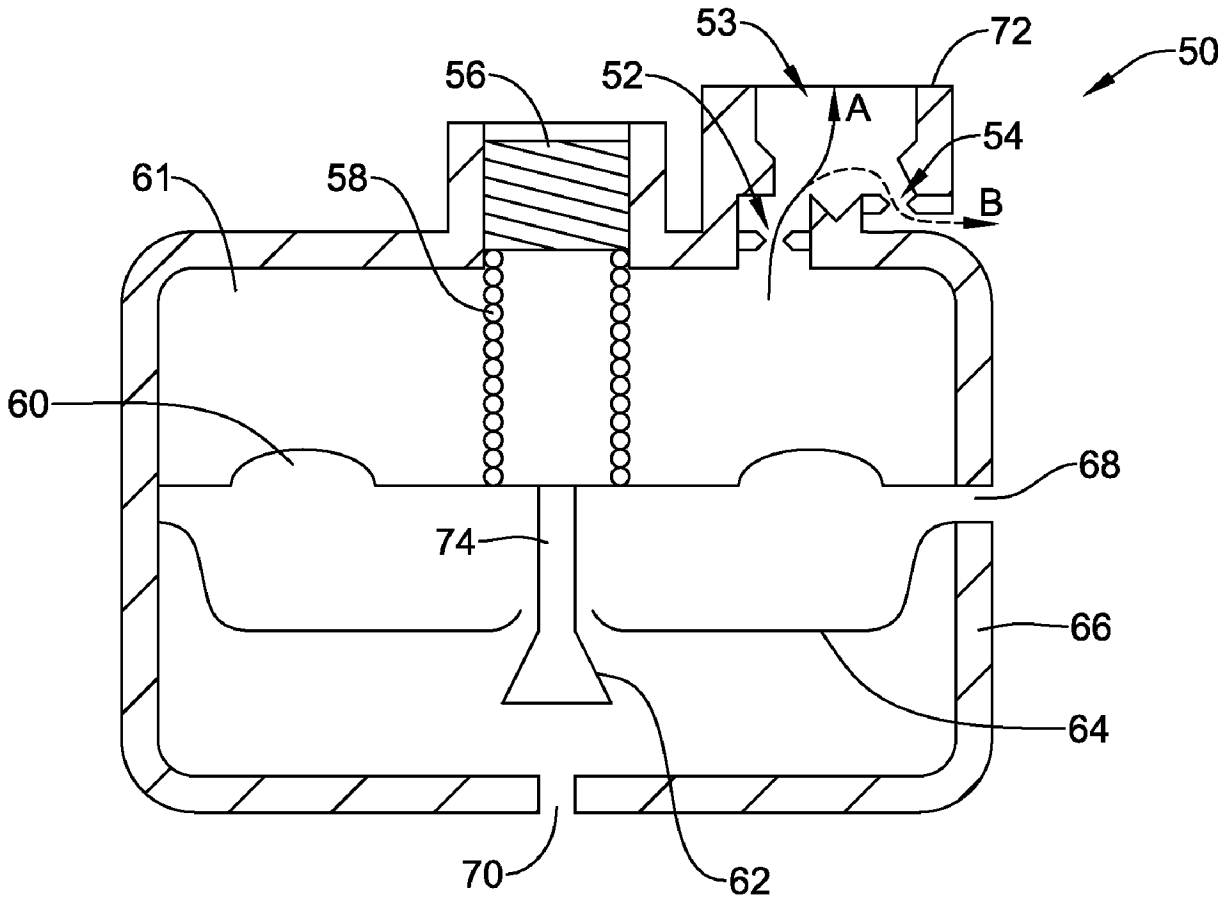
FIG. 2 is a schematic diagram of an illustrative pressure regulator including a bleed orifice in accordance with the present invention.

FIG. 2 is a schematic diagram of an illustrative pressure regulator 50 including a bleed orifice 54 in accordance with one illustrative embodiment of the present invention. In FIG. 2, the pressure regulator 50 is a diaphragm-type regulator valve. In some cases, the diaphragm-type regulator valve may be adjustable between an infinite or discrete number of positions, either manually, by influence of a reference pressure, and/or with the aid of a servo motor or other suitable mechanism, in order to regulate the flow and/or pressure of gas at the gas inlet 68 and/or gas outlet 70.

In the illustrative embodiment, the pressure regulator 50 includes a housing 66 that defines an inlet 68, an outlet 70, and a reference pressure connector 72. A diaphragm 60 is positioned within the housing 66 for regulating the flow of gas from the inlet 68 to the outlet 70. The diaphragm member 60 defines, at least in part, a reference pressure chamber 61. In the illustrative embodiment, the reference pressure connector 72, which is defined by and integral with the housing 66, includes a first opening 53 that is configured to be fluidly connected to a first reference pressure, such as the pressure in a burner box of a gas-fired appliance. The illustrative reference pressure connector 72 also includes a second opening 52 that fluidly connects the first opening 53 to the reference pressure chamber 61, a third opening 54 that is configured to be fluidly connected to a second reference pressure, such as atmosphere. The third opening 54 may correspond to a bleed orifice, and may be substantially more restrictive than the second opening 52 if desired. Should the first opening 53 become blocked or occluded for some reasons, the reference pressure connector 72 may allow the reference pressure chamber 61 of the pressure regulator 50 to reference, for example atmosphere, via the bleed orifice 54.

In the illustrative embodiment, the pressure regulator 50 may include a spring 58 operatively coupled to a valve stem 74, a stopper 62, and the diaphragm 60. The spring 58 can be configured to exert a biasing force on the diaphragm 60, causing the valve stem 74 and the stopper 62 to engage a valve seat 64. When the pressure at the inlet 68 of the pressure regulator 50 decreases relative to the pressure in the reference chamber 61, the diaphragm 60 moves down, causing the valve stem 74 and the stopper 62 to disengage from the valve seat 64. The flow of gas through the pressure regulator 50 may thus be regulated, depending on the reference pressure in the reference pressure chamber 61.

In some cases, the biasing force provided by the spring 58 can be adjusted using a suitable adjustment mechanism, such as, for example, a set screw 56, if desired. While the use of a valve stem 74 and stopper 62 are used in the illustrative embodiment of FIG. 2, it is contemplated that the diaphragm 60 itself may engage the valve seat 64. More generally, it is contemplated that any suitable pressure regulator configuration may be used, as desired, such as, for example, a regulator that allows flow as the pressure chamber pressure increases.

As shown in FIG. 2, the reference pressure connector 72 may include a first end, a second end, and a lumen or conduit extending therebetween. In the illustrative embodiment, the first end may be the upper end shown in FIG. 2, and the second end may be the lower end. The upper end may be sized to have a pneumatic pressure line 44 of FIG. 1, such as a hose or other conduit, attached thereto to provide fluid communication with a reference pressure, such as a burner box.

As shown, the opening or orifice 52 is provided adjacent to the lower end of the reference pressure connector 72 to fluidly connect the pressure chamber 61 of the pressure regulator 50 to the reference pressure connector 72. Additionally, the bleed orifice 54 is provided adjacent the opening 52 and at the lower end of the reference pressure connector 72 to reference a second pressure. The second reference pressure may be, for example, atmospheric pressure, but it is contemplated that any suitable second pressure reference may be used, as desired. It is contemplated that the bleed orifice 54 may be fluidly positioned anywhere between the orifice 52 and the upper end of the reference pressure connector 72.

In operation, the reference fitting 72 may be connected to a pneumatic pressure line 44 to fluidly connect the opening 53 to the burner box. If the pneumatic pressure line 44 (shown in FIG. 1) is not blocked or otherwise occluded, orifice 52 may allow the pressure regulator 50 to regulate the flow of gas depending on the pressure in the burner box. This may help reduce over-combustion and/or under-combustion in the burner box. At the same time, orifice 52 may be fluidly connected to bleed orifice 54. In some cases, the bleed orifice 54 may be a relatively smaller opening compared to the orifice 52. Thus, and in the illustrative embodiment, the pressure of the burner box will normally control when the pneumatic pressure line 44 is not blocked or otherwise occluded, as indicated by arrow A. If, however, the reference fitting 72 or the pneumatic pressure line 44 becomes blocked or otherwise occluded due to combustion condensate, a kink in the pneumatic pressure line 44, or for any other reason, pressure regulator 50 may reference atmosphere via the orifice 52 and the bleed orifice 54, as indicated by dashed arrow B. This may help reduce undesirable pressure build up in the reference pressure chamber 61 of the pressure regulator 50 when the fluid connection to the burner box becomes obstructed for some reason. In this case, the bleed orifice 54 may act as a safety valve for the pressure regulator 50 to prevent significant gas valve deviations during operation.

Figure 3:
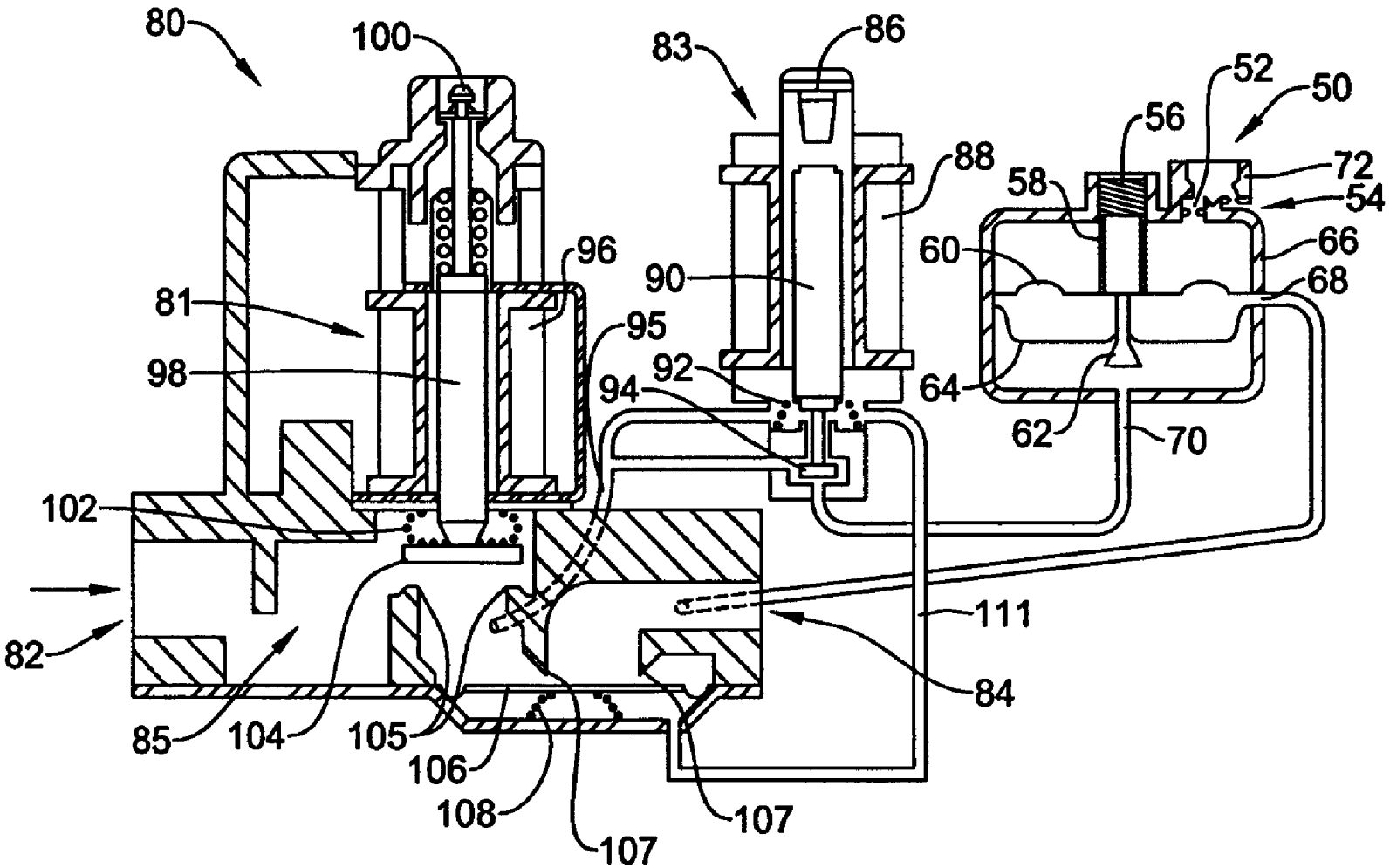
FIG. 3 is a schematic diagram of an illustrative gas valve including the illustrative pressure regulator of FIG. 2.

FIG. 3 is a schematic diagram of an illustrative gas valve 80 including the illustrative pressure regulator 50 of FIG. 2. In the illustrative embodiment, automatic valve operator 83 and pressure regulator 50 are shown outside of the gas valve housing for ease in tracing gas flows connections. However, it is contemplated that the automatic valve operator 83 and/or pressure regulator 50 may be incorporated into or otherwise positioned within gas valve housing, and in some cases, at least partially defined by gas valve housing, if desired.

In some cases, gas valve 80 may control ON-OFF gas flow for a combustion system. In the OFF state or position, gas flow to the burner box may be mechanically blocked. In the ON position, gas may flow to, for example, a burner box under control of two valve operators. In the illustrative embodiment, gas valve 80 may include a first automatic valve operator 81, a second automatic valve operator 83, and a pressure regulator 50 to control the flow of gas from a gas control inlet 82 through a gas flow conduit 85 to a gas control outlet 84. The gas valve 80 may also include a control conduit 111 that may help control, at least in part, the second automatic valve operator 83.

In the illustrative embodiment, the first automatic valve operator 81 may include a control knob 100, a solenoid or coil 96, a valve 104, a spring 102, and a movable body 98. The valve 104 may be configured to engage and disengage a valve seat 105. The control knob 100 can be turned to an ON position or an OFF position. The ON allows the flow of gas through the gas flow conduit 85, and the OFF position mechanically restricts gas flow through the gas flow conduit 85. While in the OFF position, the valve 104 may engage valve seat 105 to mechanically block the gas flow conduit 85. In some cases, spring 102 may bias valve 104 to engage valve seat 105. In the ON position, the solenoid or coil 96 can be activated to move the movable body 98. When activated, the solenoid 96 may cause the moveable body 98 to move in an upwards direction lifting the valve 104 off of the valve seat 105.

The second automatic valve operator 83 may include a control knob 86, a solenoid or coil 88, a movable body 90, a valve disc 94, a spring 92, and may further include a valve diaphragm 106 attached to a second spring 108. The valve diaphragm 106 may be configured to engage and disengage a valve seat 107. The valve diaphragm 106, which may be controlled at least in part by the pressure regulator 50, may regulate the gas flow through the gas flow conduit 85. The pressure regulator 50 may monitor the pressure at outlet 84 of the gas valve 80, and the second automatic valve operator 83 may be used to modulate the position of diaphragm valve 106 to provide an even or substantially even gas pressure at, for example, the burner box of a gas-fired appliance.

When the control unit or thermostat calls for heat, the first automatic valve solenoid 96 and second automatic valve solenoid 88 may be automatically activated by, for example, a control signal from control unit 42. When activated, the first valve 104 may be lifted off valve seat 105 and opened. Also, when activated, the second automatic valve operator valve disc 94 may be lifted off its seat (in a downward direction in FIG. 3). In this case, gas may flow through the gas control conduit 111. When the valve disc 94 is lifted off its seat, the pressure on the underside of the second automatic valve diaphragm 106 may be reduced via gas control conduit 111, which may result in the diaphragm 106 moving downward and away from the valve seat 107, allowing gas to flow to the gas flow outlet 84. The pressure regulator 50 may regulate the pressure on the underside of the valve diaphragm 106 such that the pressure at the outlet 84 is at a desired pressure level. The desired pressure level may be dependent on a reference pressure received through reference pressure connector 72 of pressure regulator 50 from, for example, a burner box of a gas-fired appliance.

A change in the sensed reference pressure at the reference pressure connector 72 may cause the pressure regulator diaphragm 60 to modulate the flow rate through the pressure regulator 50, which then may modulate or control the pressure at the outlet 84 of the gas valve 80. For example, if the pressure at the outlet 84 of the gas valve 80 begins to rise relative to the reference pressure provided by the reference pressure connector 72, the pressure regulator diaphragm 60 may move upwards, decreasing the flow of gas that is taken from the gas control conduit 111 by gas outlet 70, thereby increasing the pressure on the underside of valve diaphragm 106, which then reduces the flow and thus the pressure at gas outlet 84. Likewise, if the pressure at the outlet 84 of the gas valve 80 begins to fall relative to the reference pressure, the pressure regulator diaphragm 60 may move downward, increasing the flow of gas that is taken from the gas control conduit 111 by gas outlet 70, thereby decreasing the pressure on the underside of the valve diaphragm 106, which increases the flow and thus the pressure at gas outlet 84. Thus, the pressure at gas outlet 84 of the gas valve 80 may be regulated by pressure regulator 50.

When the call for heat ends, the first automatic valve 104 and valve disc 94 of the second automatic valve 83 may be automatically closed by, for example, a control signal from control unit 42. As pressure inside the gas control and underneath the valve diaphragm 106 equalizes, spring 108 may cause the diaphragm 106 to engage valve seat 107 and provide a second barrier to gas flow. In the illustrative embodiment, if there is a loss of power, the automatic valve solenoids 88 and 96 may be deenergized and the valve 104 and valve disc 94 may automatically close.

In some cases, the illustrative gas valve may be configured to include slow-opening regulation and/or step-opening regulation, but this is not required. Slow-opening gas control may function the substantially the same as described above except that when the thermostat calls for heat, the second automatic valve 83 may open more gradually. In one illustrative embodiment, the opening of the second automatic valve 83 is slowed by providing a flow restriction (not shown) in the fluid path 95, which slows the rate at which gas pressure can be reduced under the second automatic valve diaphragm 106.

Step-opening gas control may combine two pressure regulators, one for the low pressure condition and one for a higher or the full-rate pressure condition. When step-opening gas control is employed, the automatic operator valve disc 94 may open when a call for heat is received. A low pressure regulator may maintain the outlet pressure at a preset step rate for several seconds. Then, the regulator valve may be forced fully open by bleed gas. When the low pressure regulator is fully open, the high pressure regulator may maintain the desired full-rate outlet pressure as described above. In some cases, a step-opening gas control model may need some time, such as for example 60 seconds, to reset once the main burner goes off. If it is reenergized within that interim time period, it may bypass or shorten the length of the low pressure step.

Figure 4:
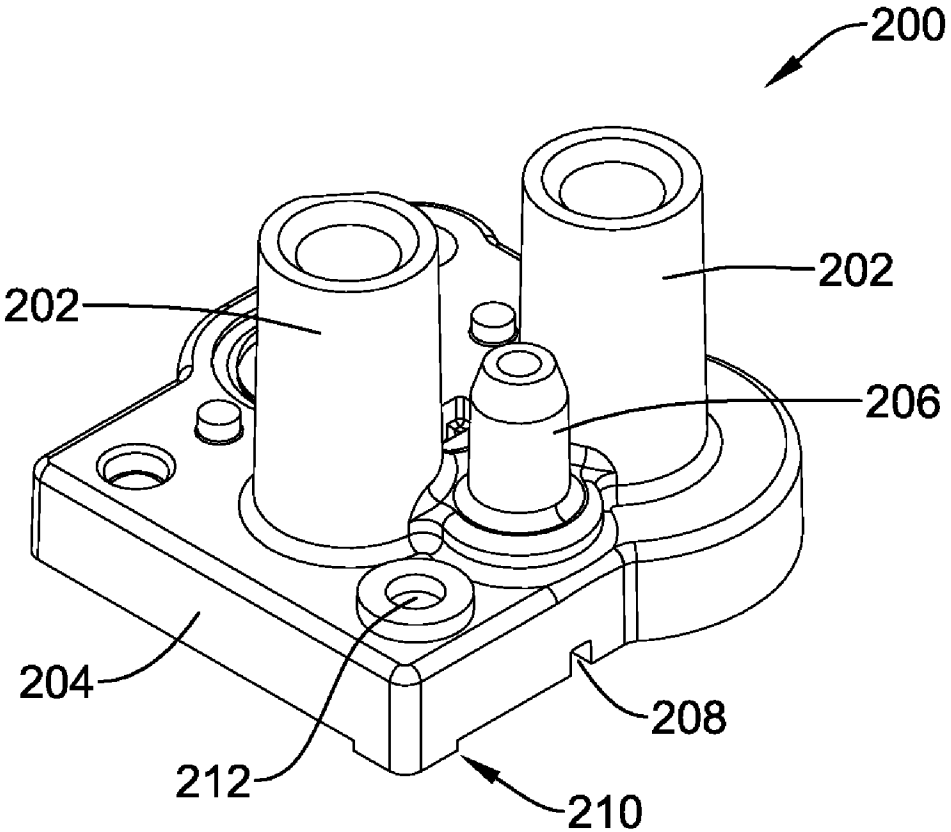
FIG. 4 is a perspective view of an illustrative pressure regulator.

FIG. 4 is a perspective view of another illustrative pressure regulator 200. In the illustrative embodiment, the pressure regulator 200 includes a housing 204. The housing 204 may define and/or otherwise include a reference pressure connector 206 and one or more pressure towers 202. In some cases, the reference pressure connector 206 may be integrally formed with the housing 204. Like above, the reference pressure connector 206 may fluidly couple a reference pressure, such as, for example, the pressure from a burner box through a pneumatic pressure line, to a pressure chamber within the pressure regulator 200. In some cases, though not shown explicitly in FIG. 4, reference pressure connector 206 may include one or more protrusions extending around at least a portion of an outer surface of the connector 206 to help secure a hose, tube or other pneumatic pressure line, as desired.

In the illustrative embodiment, pressure regulator 200 includes two pressure towers 202, although this is not required. Each of the pressure towers 202 may include a pressure setting screw (not shown) that may variably set and/or adjust the bias pressure against a corresponding diaphragm of a diaphragm member 216 in the pressure regulator 200 (see FIG. 5). In some case, the pressure setting screw(s) may be coupled to a spring 214 (see FIG. 5) to exert the bias pressure on the diaphragm member 216. In the illustrative embodiment, by incorporating two pressure towers 202, each including a pressure setting screw and spring 214 to bias a corresponding diaphragm of diaphragm member 216, the pressure regulator 200 may be able to regulate two different flow rates or pressures at the same time. However, this is not meant to be limiting and it is contemplated that a single pressure tower 202, spring and diaphragm may be used, if desired.

An opening 208 may be provided in the housing 204 to fluidly connect a bleed orifice to a reference pressure, such as, for example, atmospheric pressure. In the illustrative embodiment, opening 208 may extend through a bottom portion of a side wall of the housing 204. In one embodiment, the side opening 208 may include a notch in the housing 204 as shown. However, it is contemplated that the opening 208 may be provided in any suitable location of the housing 204, such as, for example in a portion of the reference pressure connector 206, on the upper surface of the housing 204, or in any other suitable location, as desired. In some cases, the opening 208 may be fluidly coupled to the reference pressure connector 206 via a bleed orifice and/or other conduit, as desired.

In some cases, the pressure regulator 200 may include one or more mounting holes 212, which may be used to mount the pressure regulator 200 to a valve body (not shown). In some cases, the pressure regulator housing 204 may include a bottom surface having a protrusion 210. The protrusion 210 may help the side opening 208 reference atmosphere when mounted to a valve body. In some cases, when mounted on a valve body, side opening 208 may be provided in a location where it is less likely to become easily blocked with grease or other material, if desired.

Figure 5:
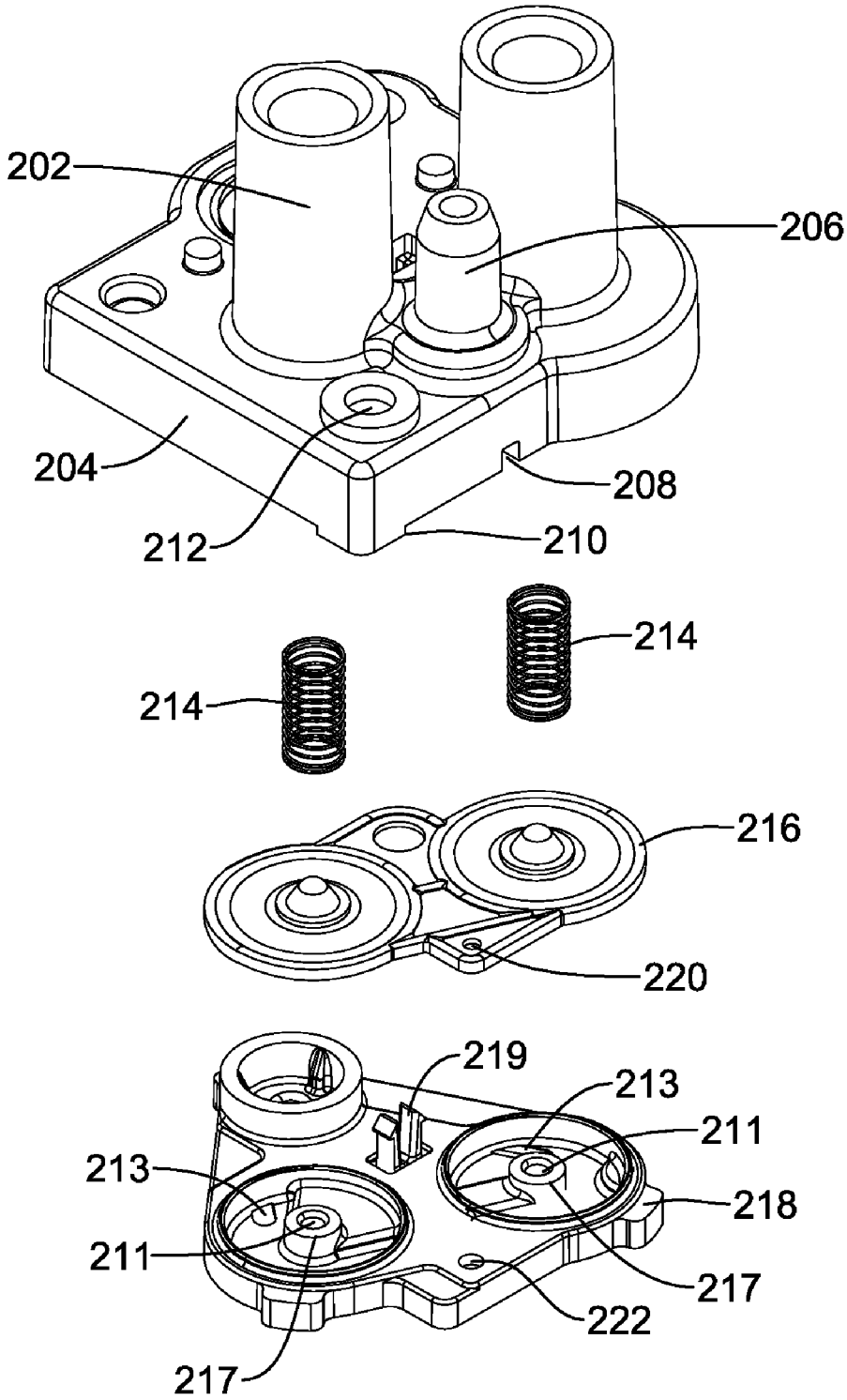
FIG. 5 is an exploded view of the illustrative pressure regulator of FIG. 4.

FIG. 5 is an exploded view of the illustrative pressure regulator of FIG. 4. As illustrated, the pressure regulator 200 may include a housing 204 that has a reference pressure connector 206, two pressure towers 202, two springs 214, a diaphragm member 216 having two separate diaphragms, and a valve seat housing 218. The springs 214 may be positioned to fit within a corresponding one of the pressure towers 202. In some cases, the springs 214 may be configured to exert a bias pressure on a corresponding diaphragm of the diaphragm member 216 when assembled. As illustrated, each of the two diaphragms formed by the diaphragm member 216 may be positioned over a corresponding valve seat 217 formed by the valve seat housing 218. In some cases, the diaphragm member 216 may include a bleed opening 220 which may be in fluid communication with the bleed orifice of the reference pressure connector 206 and the opening 208 in the housing 204, as further described below.

The illustrative valve seat housing 218 includes a pair of gas inlets 211 and gas outlets 213. In the illustrative embodiment, there are two inlets 211 and two outlets 213, one for each of the two separate gas valves, but this is not required. The terms inlet and outlet are used in a somewhat arbitrary manner. In some cases, and depending on the direction of gas flow, the two inlets may correspond to reference numbers 213 and the two outlets may correspond to reference numbers 211.

The diaphragm member 216 may be configured to contact the valve seats 217 of the valve seat housing 218, and fluidly seal the inlets 211 from the outlets 213 when the valves are closed. In some cases, valve seat housing 218 may be formed from plastic or any other suitable material or material combination, as desired. The illustrative valve seat housing 218 includes an opening 222, which may be the bleed orifice and in fluid communication with the reference pressure connector 206 and the opening 208 in the housing 204. Bleed orifice 222 may be aligned with opening 220 of the diaphragm member 216 to provide a fluid path to the side opening 208 in the housing 204 and ultimately to a reference pressure, such as, atmospheric pressure.

In the illustrative embodiment, a connector 219 may secure the valve seat housing 218, diaphragm member 216, and housing 204 together. In some cases, connector 219 may extend from the valve seat housing 218 through or along side the diaphragm member 216, and connect to corresponding slots in the housing 204. In some cases, the connector 219 may include a snap-type connector, as shown. In an alternative case, the connector 219 may be a threaded hole configured to receive a fitting, such as a barbed fitting, if desired. It is contemplated, however, that any suitable connection mechanism may be used to secure the pressure regulator assembly together, including screws, bolts, adhesives, or any other suitable mechanism, as desired.

Figure 6:
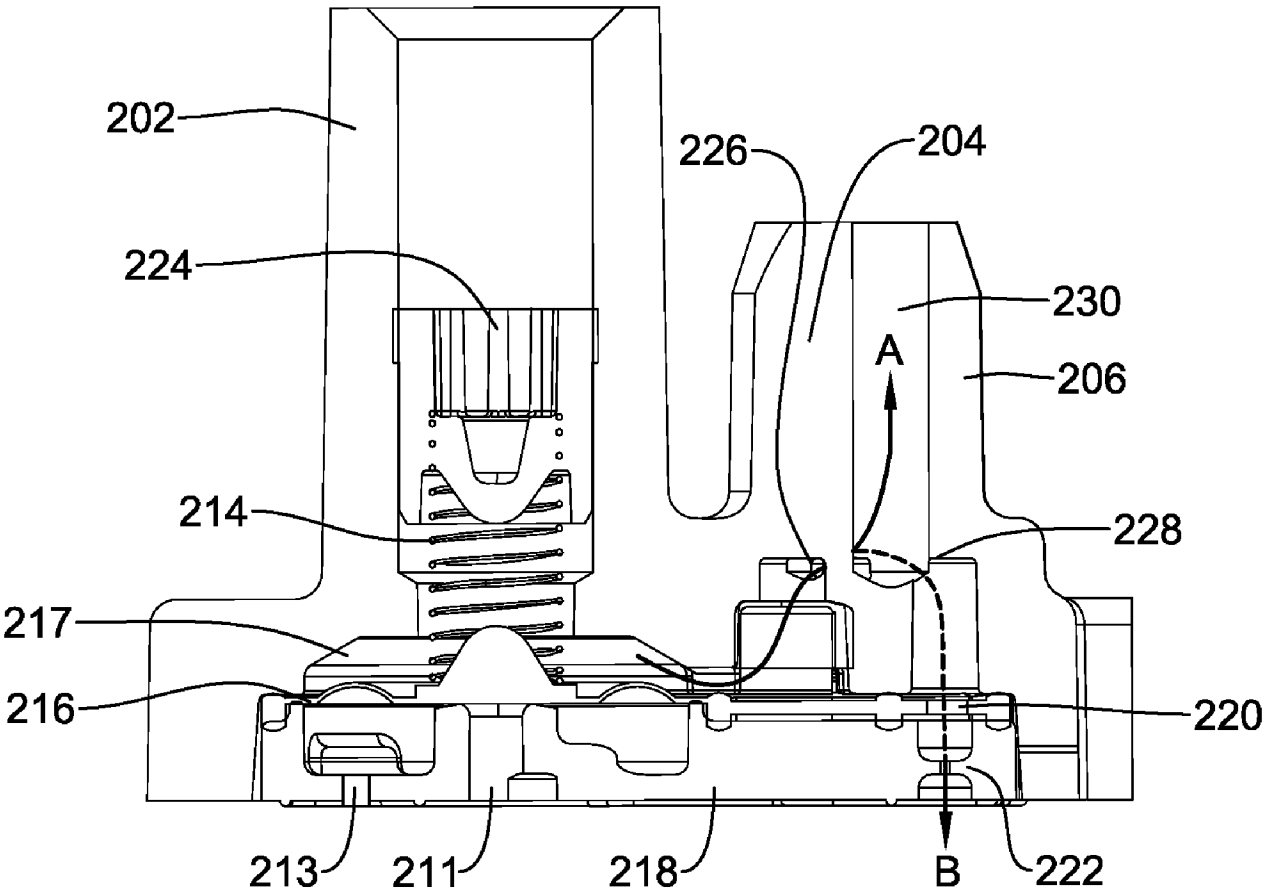
FIG. 6 is a cross-sectional view of the illustrative pressure regulator of FIG. 4.

FIG. 6 is a partial cross-sectional view of the illustrative pressure regulator 200 of FIG. 4 showing one of the pressure towers 202 and the reference pressure connector 206. As illustrated, spring 214 is positioned between a set screw 224 and diaphragm member 216. As set screw 224 is adjusted, the bias provided by the spring 214 to the diaphragm member 216 is adjusted, thereby adjusting the regulated output pressure of the pressure regulator 200.

In FIG. 6, the reference pressure connector 206 includes a top end, a base end, and a lumen or conduit 230 extending therebetween. The top end in FIG. 6 includes an opening to fluidly connect the reference pressure connector 206 to a pneumatic pressure line or the like for connection to a reference pressure such as a pressure in a burner box of a gas-fired appliance. The base end of the reference fitting 206 may be in fluid connection with a pressure chamber 217 behind the diaphragm member 216 through an orifice 226. The base end of the reference fitting 206 may also be in fluid connection with a bleed orifice 222. The fluid path for the bleed orifice reference pressure may pass through opening 228, opening 220 in the diaphragm member 216, bleed orifice 222 in the valve seat housing 218, and out side opening 208 in housing 204 to a second reference pressure, such as the atmospheric pressure.

In the illustrative embodiment, pressure chamber 217 is able to reference a first pressure reference, such as, for example, the pressure in the burner box through reference pressure connector 206 via orifice 226, as indicated by arrow A. In addition, pressure chamber 217 is able to reference a second pressure reference, such as atmospheric pressure, through orifice 226 and bleed orifice 222, as indicated by dashed arrow B. In some cases, the bleed orifice 222 or some other restriction downstream therefrom may be sized relatively smaller than orifice 226. When so provided, and in the illustrative embodiment, the pressure of the first pressure reference (e.g. the burner box) will normally control the position of diaphragm member 216. If the reference pressure connector 206 or the pneumatic pressure line 44 (of FIG. 1) to the burner box becomes blocked or otherwise occluded due to combustion condensate, a kink in the pneumatic pressure line, or for any other reason, pressure chamber 217 may reference atmospheric pressure (or some other reference pressure) via the bleed orifice 222, as indicated by dashed arrow B. This may help reduce pressure build up in the pressure chamber 217 when the fluid connection to the burner box becomes obstructed or otherwise occluded for some reason. In this case, the bleed orifice 222 may act as a safety valve for the pressure chamber 217 to prevent significant gas valve deviations during operation.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respect, only illustrative. Changes may be made in details, particularly in matters of shape, size, and arrangement of parts without exceeding the scope of the invention. The invention's scope is, of course, defined in the language in which the appended claims are expressed.

The invention claimed is:

1. A pressure regulator comprising:

a housing defining an inlet, an outlet, and a reference pressure connection;

a diaphragm member positioned within the housing for regulating the flow of gas from the inlet to the outlet, the diaphragm member defining, at least in part, a reference pressure chamber; and the reference pressure connection including a first opening configured to be fluidly connected to a first reference pressure, a second opening fluidly connected to the reference pressure chamber, and a third opening configured to be fluidly connected to a second reference pressure, the second reference pressure different than the first reference pressure, and wherein the first opening, the second opening and the third opening are fluidly connected.

2. The pressure regulator of claim 1 wherein the first reference pressure corresponds to a burner box pressure of a combustion system.

3. The pressure regulator of claim 2 wherein the second reference pressure is atmosphere.

4. The pressure regulator of claim 1 wherein the reference pressure connection is configured to receive a pneumatic pressure line for connection to the first pressure reference.

5. The pressure regulator of claim 1 wherein the second opening is a vent orifice and the third opening is a bleed orifice, wherein the bleed orifice is of a different size than the vent orifice.

6. The pressure regulator of claim 1 wherein the housing includes a first portion and a second portion, wherein the second portion includes a valve seat housing that provides a valve seat for at least part of the diaphragm member, the second portion of the housing secured to the first portion of the housing.

7. The pressure regulator of claim 6 wherein the diaphragm member is situated between the first portion of the housing and the second portion of the housing.

8. The pressure regulator of claim 7 further comprising a biasing element for biasing at least part of the diaphragm member toward the second portion of the housing.

9. A pressure regulator comprising:

a housing defining an inlet, an outlet, and a reference pressure connection;

a diaphragm member positioned within the housing for regulating the flow of gas from the inlet to the outlet, the diaphragm member defining, at least in part, a reference pressure chamber;

the reference pressure connection including a first opening configured to be fluidly connected to a first reference pressure, a second opening fluidly connected to the reference pressure chamber, and a third opening configured to be fluidly connected to a second reference pressure;

wherein the housing includes a first portion and a second portion, wherein the second portion includes a valve seat housing that provides a valve seat for at least part of the diaphragm member, the second portion of the housing secured to the first portion of the housing;

wherein the diaphragm member is situated between the first portion of the housing and the second portion of the housing; and wherein the third opening is fluidly connected to the second reference pressure via a bleed opening through at least part of the diaphragm member.

10. The pressure regulator of claim 9 wherein the second portion of the housing has an opening that is in fluid communication with the bleed opening in the diaphragm member.

11. The pressure regulator of claim 10 wherein the first portion of the housing has an opening to atmosphere that is in fluid communication with the opening in the second portion of the housing.

12. The pressure regulator of claim 1 further comprising a gas valve, wherein the pressure regulator is mounted to the gas valve.

13. A pressure regulated gas valve for a combustion appliance having a burner box, comprising:

a gas valve having a gas inlet and a gas outlet, the gas valve having one or more pneumatic channels for regulating the gas pressure at the gas outlet;

a pressure regulator having an inlet and an outlet, at least one of which is coupled to one or more of the pneumatic channels of the gas valve for regulating one or more pressures in the one or more pneumatic channels, and therefore, to regulate the gas pressure at the gas outlet of the gas valve;

the pressure regulator having a housing with an integral reference pressure connection, and a diaphragm member positioned within the housing for regulating the pressure between the inlet and the outlet of the pressure regulator, the diaphragm member defining, at least in part, a reference pressure chamber; and the reference pressure connection including a first opening configured to be fluidly connected to a pneumatic pressure line, a second opening fluidly connected to the reference pressure chamber, and a third opening configured to be a bleed orifice that is exposed to atmosphere, wherein the first opening, the second opening and the third opening are fluidly connected.

14. The pressure regulated gas valve of claim 13 further comprising a pneumatic pressure line having one end fluidly coupled to the reference pressure connection and another end fluidly coupled to the burner box of the combustion appliance.

15. A gas valve comprising:

a valve body having a gas inlet, a gas outlet, a main gas conduit in fluid communication with the gas inlet and the gas outlet when the gas valve is in an open position, the valve body further including a gas control conduit;

a valve diaphragm positioned within the main gas conduit to control the flow through the main gas conduit, the valve diaphragm controlled, at least in part, by the gas control conduit; and a pressure regulator having an inlet, an outlet and a reference pressure connection, wherein the inlet is in fluid communication with the gas control conduit and the outlet is in fluid communication with the gas outlet of the valve body, the pressure regulator including a diaphragm for regulating the gas flow from the inlet of the pressure regulator to the outlet of the pressure regulator relative to a first reference pressure provided through a first orifice of the reference pressure connection of the pressure regulator, the reference pressure connection of the pressure regulator further including a second orifice that references a second pressure.

16. The gas valve of claim 15 further comprising a control valve positioned between the inlet of the pressure regulator and the gas control conduit and fluidly connecting the inlet of the pressure regulator and the gas control conduit when the control valve is in a open position.

17. The gas valve of claim 16 wherein the control valve includes a fluid path that is in fluid communication with the main gas conduit upstream of the valve diaphragm, wherein the control valve fluidly connects the fluid path that is in fluid communication with the main gas conduit upstream of the valve diaphragm and the gas control conduit when in a closed position, and fluidly connects the fluid path that is in fluid communication with the main gas conduit upstream of the valve diaphragm and the inlet of the pressure regulator when in an open position.

18. The gas valve of claim 15 wherein the valve diaphragm and the pressure regulator are situated within the valve body.

19. The gas valve of claim 15 wherein the valve diaphragm is situated within the valve body, and the pressure regulator is situated within a separate pressure regulator body, and wherein the pressure regulator body is secured to the valve body.

20. The gas valve of claim 15 wherein the reference pressure corresponds to a pressure within a burner box of a combustion system which is transmitted to the reference pressure connection via a pneumatic pressure line.

21. The gas valve of claim 20 wherein the second pressure is atmosphere.

22. The gas valve of claim 15 wherein the second orifice is a bleed orifice that is more restrictive than the first orifice.

23. The gas valve of claim 15 wherein the reference pressure connection is configured to receive a pneumatic pressure line.

24. A pressure regulator comprising:

a housing defining a gas inlet, a gas outlet, and a reference pressure connection;

a diaphragm positioned within the housing for regulating the flow of gas from the gas inlet to the gas outlet, the diaphragm defining, at least in part, a pressure chamber; and wherein the reference pressure connection includes a first end, a second end, and a conduit extending therebetween, the reference pressure connection providing a fluid path from the pressure chamber to a first reference pressure and to a second reference pressure;

wherein the first reference pressure is provided to the pressure chamber via a first orifice adjacent the first end of the reference pressure connection;

wherein the second reference pressure is provided to the pressure chamber via the first orifice adjacent the first end of the reference pressure connection and a second orifice adjacent to the first end of the reference pressure connection; and the second end of the reference pressure connection is configured to be fluidly coupled to a pneumatic pressure line.

25. The pressure regulator of claim 24 wherein the pneumatic pressure line has one end fluidly coupled to the second end of the reference pressure connection and another end fluidly coupled to a burner box of a combustion appliance.

* * * * *